United States Patent [19]

Vigh

[11] 4,080,770

[45] Mar. 28, 1978

[54] HIGH CHAIR SPACER

[76] Inventor: Sandor Vigh, 214 Nantucket Blvd., Scarborough, Canada, M1P 2N9

[21] Appl. No.: 778,789

[22] Filed: Mar. 17, 1977

Related U.S. Application Data

[63] Continuation-in-part of Ser. No. 602,088, Aug. 5, 1975, abandoned.

[30] Foreign Application Priority Data

Aug. 6, 1974 Canada ..... 206366

[51] Int. Cl.[2] ..... E04C 5/16

[52] U.S. Cl. ..... 52/689

[58] Field of Search ..... 52/677-689, 52/698, 699, 697; 248/163, 80, 83, 175

[56] References Cited

U.S. PATENT DOCUMENTS

| | | | |
|---|---|---|---|
| 1,921,538 | 8/1933 | Priest | 52/685 |
| 2,064,705 | 12/1936 | Whitehead | 52/685 |
| 3,209,509 | 10/1965 | O'Callaghan | 52/688 |
| 3,289,378 | 12/1966 | Carroll | 52/688 |
| 3,289,379 | 12/1966 | Watts | 52/678 |
| 3,488,907 | 1/1970 | Aberg | 52/689 X |
| 3,788,025 | 1/1974 | Holmes | 52/685 |

FOREIGN PATENT DOCUMENTS

| | | | |
|---|---|---|---|
| 93,873 | 10/1962 | Denmark | 52/689 |
| 213,644 | 6/1967 | Sweden | 52/687 |

*Primary Examiner*—J. Karl Bell

*Attorney, Agent, or Firm*—D. Paul Weaver

[57] ABSTRACT

A high chair spacer, for use in concrete construction and casting, for locating reinforcing rods and other elongated bodies to be placed in the concrete, such as cables, pipes or ducting, and a method for making such a spacer, which consists of a plastic base and a metal wire standoff spacer member and a plastic standoff member supported in the base. The metal member provides the strength necessary for receiving and supporting reinforcing rods but is protected from corrosion by the tough plastic base. The metal member is received in tubular-shaped recesses in the base. The high forces transmitted to the base by the metal member, and overturning lateral forces are resisted by the specifically designed base. The plastic standoff members straddles the metal member and is secured in cooperating slots in the base. Tabs may be provided on the base for positively attaching it to supporting formwork structure.

9 Claims, 7 Drawing Figures

HIGH CHAIR SPACER

This application is a continuation-in-part of my Application 602,088 filed Aug. 5, 1975 now abandoned.

This invention is for an improved spacer chair for reinforcing rods used in the making of reinforced concrete structures.

In reinforced concrete construction, steel rods are provided in those regions where the concrete will be placed under tension in use, the rods being oriented in the direction of the tensile stress. Concrete is very strong in compression, but is weak in tension and if not reinforced, will fail due to cracks originating in the regions subjected to tensile stress. The practice, therefore, is to arrange formwork around the space in which the concrete is to be poured, and to stand off the rods from the edges of the formwork at the position required by means of spacers or "chairs", so that the rods will be totally enclosed in the finished concrete. Rods which are to be spaced only a short distance from the edge of the formwork are held in position by chairs of low height, whereas those further into the concrete require larger or "high chair" spacers. In the past, problems have arisen in that if the chairs are made of steel, the edges of these chairs will be exposed to the environment during the life of the reinforced concrete structure, which will very shortly lead to corrosion and rusting. Apart from the unsightly appearance, the rusting of the steel passes inwards from the chair to the reinforcing rods and consequently, in time, to the weakening of the entire structure. Rust occupies a larger volume that the unoxidized steel from which it is formed, and this can also lead to expansive cracking of the concrete.

This corrosion problem has been met in the industry generally by the provision of chairs made of plastic and a particularly satisfactory structure in which the chair is made up as a continuous bolster on which many rods can be received on a single unit, is disclosed in my U.S. Pat. No. 3,839,838, issued Oct. 8, 1974.

With high chair spacers, a quite different problem arises. While it is possible to make such large standoff spacers of plastic to avoid corrosion, they occupy considerable volume otherwise filled with concrete, which can affect the strength of the finished structure. More importantly, such plastic high chair spacers are expensive, since large volumes of plastic must be used. Additionally, to provide the strength necessary fo the support of the weighty reinforcing rods, the plastic must be of a high quality, tensile strength and toughness, and in consequence is of high price. Steel is cheaper, but it suffers from the corrosion problems mentioned above.

An additional problem of the prior art chairs is that since each reinforcing rod job requires spacers of different heights, it has been necessary to make spacers which are adjustable, or to provide a wide range of spacers of exactly the right size, which again has been expensive. High chair spacers of the type shown in U.S. Pat. No. 3,289,379, of plastic have included intermediate members which can be cut to fit on the site. This is wasteful, in that more plastic must be provided than is needed in order to allow for the maximum height of standoff necessary. Threaded steel members are another solution, though again expensive, provided in U.S. Pat. No. 2,345, 976. Further, the spacer structure is all steel with consequent corrosion problems.

It is also sometimes necessary to introduce other elongated bodies into cast concrete such as stressing or electrical, power, signalling or other cables; plumbing, heating or refrigeration lines or ducting etc. Such bodies must be properly supported so that they are placed in the proper regions of the concrete. The stressing cables must be placed where they will ensure that the finished concrete will always be maintained under compressive stress. Cables for other purposes must be located where they will be protected and are in alignment with those areas where they are to leave the finished concrete structure. The location of such bodies should have as little detriment as possible to the strength properties of the concrete.

Precision placing of these elongated bodies can be effected by standoff spacers from the formwork but such spacers must not interfere with the reinforcing rod spacing described above.

It is to overcome many of the problems of the prior art, that the present invention has been conceived, providing strong spacers of the required height, free from corrosion tendencies, at economical price. Additionally, effective support and orientation for other bodies in the concrete is provided.

More particularly in accordance with the invention there is provided, a high spacer chair for concrete reinforcing rods and for receipt in supporting formwork structure which comprises in combination;

a plastic base and a metal wire standoff spacer member insertably supported therein;

said metal wire member comprising a material capable of providing the predetermined strength necessary for receiving and supporting a reinforcing rod directly thereon and wherein said metal is subject to corrosion when exposed to the environment, said metal wire member being preformed to a predetermined size, having parallel oriented equilength downwardly depending legs for receipt and securing within the plastic base and an area defined on said member intermediate said legs for receipt of the reinforcing rod thereon, said base comprising a tough plastic and including a pair of parallel planar wings with a web transversely joining the wings, said wings comprising feet at outward downwardly directed ends thereof, at least one foot of each wing portion being positively securable on said formwork structure, a pair of substantially tubular vertically extending recesses integrally defined with said web, each recess being inwardly of a respective wing and defining a deep hole portion open at its upper end and terminating at its lower end adjacent to but spaced upwardly from a respective bottom foot, the said bottom feet and said wing feet being coplanar, each said recess securely receiving therein a respective leg of said wire member, with the lower end of each said leg abutting against the lower end of its respective hole, the lower end of each leg of said wire member thereby being spaced upwardly from the respective bottom foot, vertical thrusts in said legs of said metal wire member being transmittable directly against the lower end of the respective hole and thence directly to the respective bottom foot and thus to said formwork, a pair of vertically extending slots defined in said base at the junction of said wing and said web, a trestle member extending upwardly from the base including a pair of legs, and a transverse beam section, the legs of said trestle member being receivable in said slots for locating said beam section above said reinforcing rod receiving area on said wire member, said web ensuring mutually fixed spaced separation of the legs of the wire member, and said wire member being isolated from the effects of environmental corrosion when said spacer is present in a reinforced concrete structure, and overturning forces applied to said spacer being resisted by the outward spearation of said wing feet from the legs of said wire member.

The trestle legs may be of T-section and the beam section may include a centrally disposed lower reinforcing web. Ribs may be raised along the upper side of the beam for receipt and location of elongated bodies on the beam. Tabs may be provided on at least one of the feet on each of the wings for positively attaching the feet to the supporting formwork structure. The outward faces of the slots may be relieved to receive the arms of the T-section trestle legs.

A description of specific embodiments of the invention now follows, where reference will be made to the drawings, in which.

Figure 1:
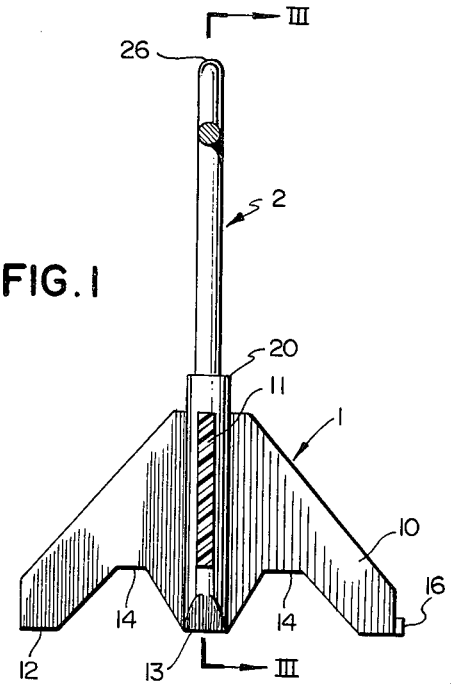
FIG. 1 shows a side view of one embodiment of the invention and sectioned along line I—I of FIG. 2.
Figure 2:
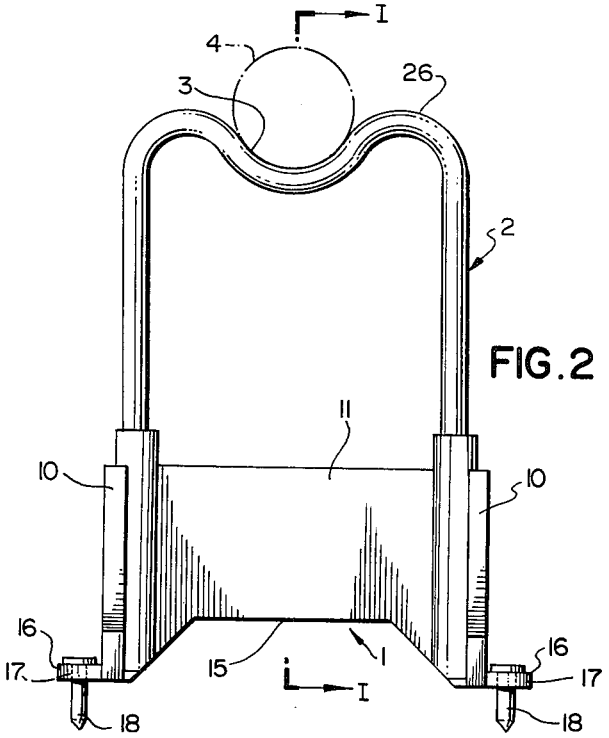
FIG. 2 is a front view of the device of FIG. 1.
Figure 4:
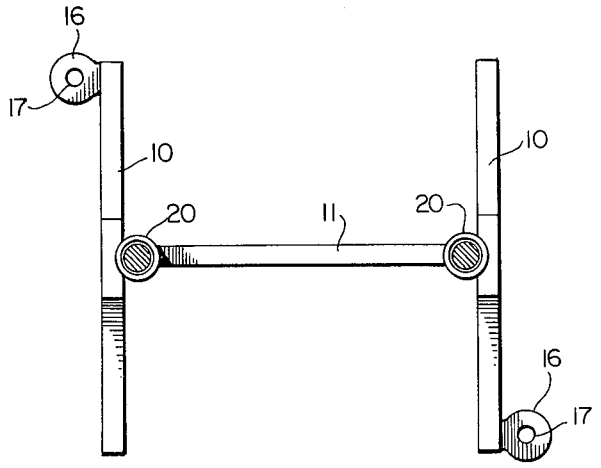
FIG. 4 is a partly sectional view along line IV—IV of FIG. 3.

Having reference to the figures, a tough plastic base 1 supports a steel wire 2, which is shaped at 3 to receive a concrete reinforcing rod shown schematically at 4 by broken lines. The base member comprises two end wing portions 10 joined together by a web 11. Each of the wings is generally triangular in shape, formed at its outer ends into feet 12. The central web at each of its outer ends where it joins the lower portions of the triangular wing merges with feet 13. Both the wings and the web are relieved at their under sides 14 snd 15, between feet 12 and 13 and between the feet 13, respectively, firstly so that the support of base 1 will be only at the feet (thereby reducing the area of plastic flush with the surface of the finished concrete), and secondly, to conserve the quantity of plastic used in making up the wings and the web. The arched form of the undersides allows the saving of plastic without significant loss of strength. At least one of the feet 12 on each wing 10 is formed with outwardly projecting fastening tabs 16, preferably pierced with holes 17, so that, if required in any particular instance, the feet 12 may be nailed down to the formwork by means such as nails 18. When the formwork is later removed from the concrete, the nails 18 will pull through the feet 16 remaining attached to the formwork, and be removed with it.

Figure 3:
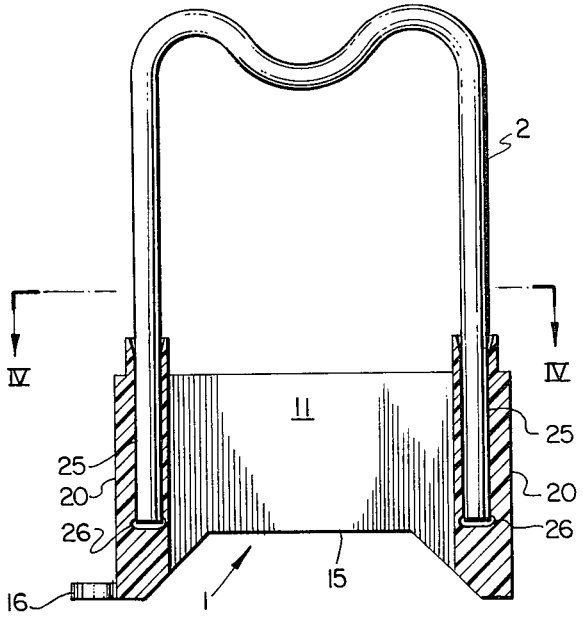
FIG. 3 is a sectional view along line III—III of FIG. 1.

The steel wire 2 is tightly received within the base 1, as best seen in FIG. 3, by the provision of tubular recesses 20 formed integrally with the web 11 and the wings 10, but inwardly of the wings. The lower ends of the wire may be knurled or roughened to increase the bonding, should it be desired in any particular instance. The ends of the wire may also be thickened or upset as at 26. A suitable thickness of plastic (say ¼ to ½ inch) separates the internal lower end of each recess 20 from the underside of its bottom foot 13 corrosion of the wire member 2 is thus avoided.

In the construction of this spacer, the steel wire 2 may be inserted into and retained in the base 1 by several methods. One method is to cast the plastic base 1 by injection molding a thermoplastic material. Holes 25 are formed in the recesses 20 during the molding process. The cast base is subsequently ejected from the mold after initial solidification while it is still hot, and the preformed wire 2 is inserted into the molded base. As the thermoplastic base cools, it contracts, forming a tight, inseparable bond with the wire.

An alternative method is to insert the wire into the mold, form the molten thermoplastic round the wire by injection molding, and then eject the entire finished article from the mold. In this instance, upsetting as at 26 can simply provide yet tighter bonding to the plastic. In another method, the wire may be inserted into the cast base after it has cooled. Bonding material such as glue may also be employed between the wire and base by this method.

It is possible for the wire 2 to be made of any size, and the wire is inexpensive. The more expensive plastic base remains of one size regardless of height of the spacer. Spacers for any exact size can be manufactured cheaply with the same molding apparatus. At the same time, because of the strength of the base, very effective securing and locating of the wire 2 is afforded. The spacer can be placed with the minimum of time and effort by the construction crew, and where necessary, can be positively located by nailing to the formwork. The reinforcing rod is received at 3 inwardly of the legs of wire member 2. Vertical forces are transmitted through the legs directly to the bottom feet 13 on recesses 20 and thence to the formwork. The wings with their outwardly placed feet 12 prevent overturning of the spacer due to forces transmitted to the spacer longitudinally of the rod. The outward disposition of the legs of wire member 2 with respect to the reinforcing rods and the yet further outward disposition of the wings on the web 11 beyond the recesses 20 effectively prevent lateral overturning of the spacer due to side forces on the reinforcing rod during construction.

The preferred material to use for the tough plastic base is high-density polyethylene. Other materials are polypropylene, or nylon, but any mouldable thermoplastic might be employed. The wire 2 can be simple mild steel, which is easily bent and cut to the required shape and size. In a prototype embodiment the steel wire was 3/16 inch, the nailing tabs 16 extended ⅜ inch out from the vertical faces of the feet 12, with a ⅛ inch nailing hole provided in the tabs. It has also been found desirable to provide spacers of an overall height, from feet 13, 13 to the top of the wire spacer at 26, covering the range in quarter-inch increments from 3 inches to 14 inches.

Figure 5:
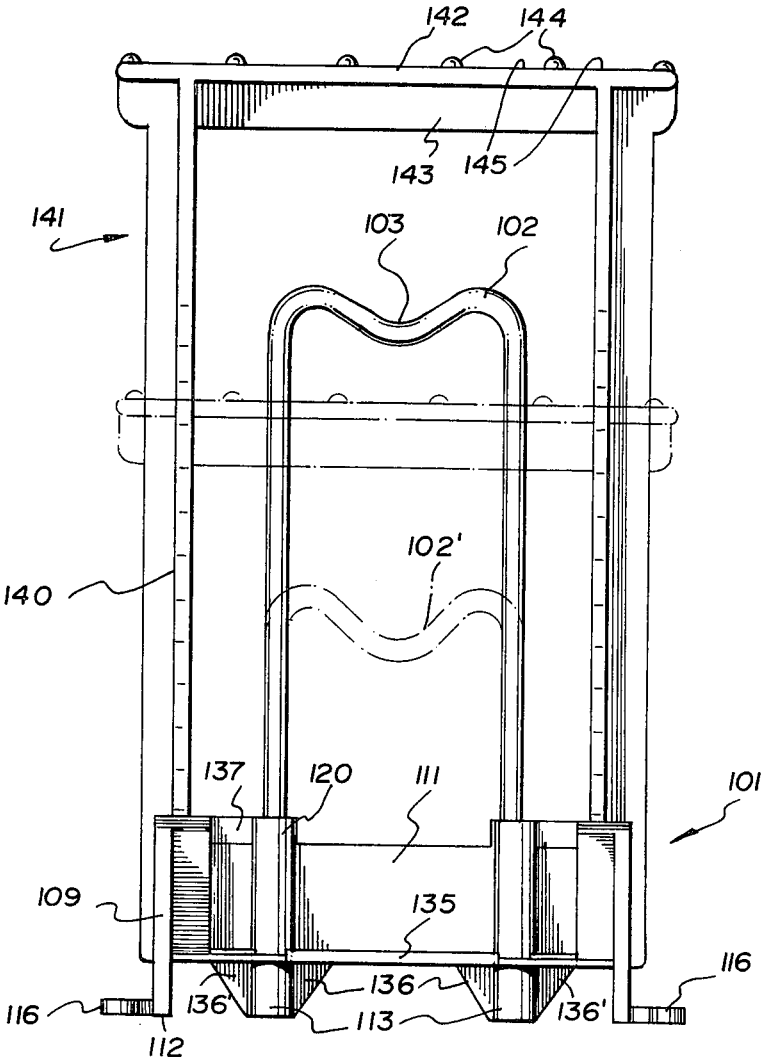
FIG. 5 is a side view of a second embodiment of the invention illustrating a double support arrangement.
Figure 6:
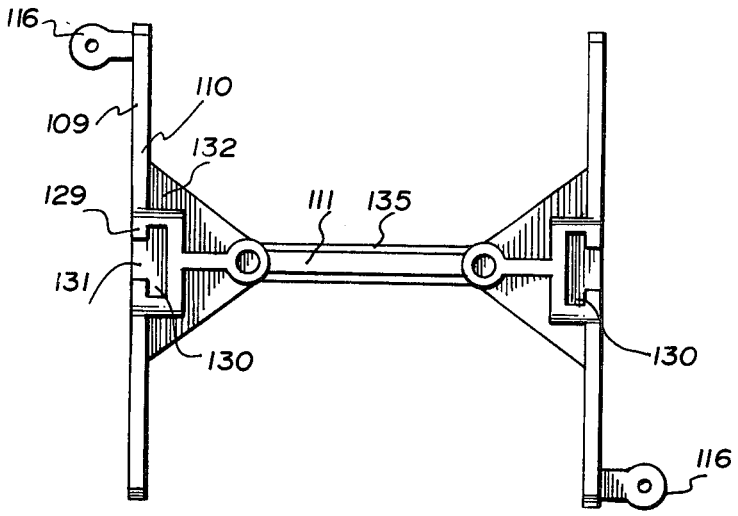
FIG. 6 is a plan view of the base of FIG. 5.
Figure 7:
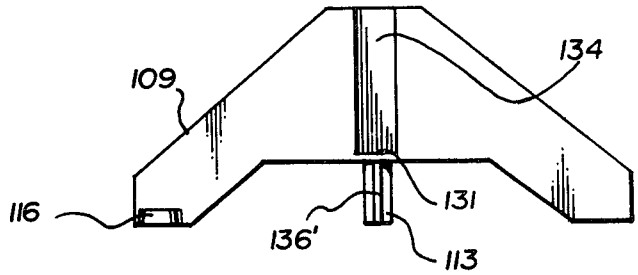
FIG. 7 is an end view of FIG. 6.

FIGS. 5 and 6 illustrate an embodiment of the invention in which the base of FIGS. 1 to 4 is constructed at 101 so that a supported wire member 102 is received with its legs in tubular recesses 120 integrally provided on web 111 and which include feet 113 adapted to contact the formwork surface upon which base 101 is mounted and fastened by tabs 116. The legs of wire member 102 terminate in the tubular means 120, upwardly from the feet 113, so that a plastic portion of, say, ¼ inch thickness exists between the bottom of a leg and the surface of a foot 113 which conacts the formwork. In the finished concrete therefore the metal of member 102 is protected from the environment by this ¼ inch of plastic. Corrosion therefore is prevented.

The web 111 continues beyond the tubular recesses 120 and terminates at each end in open sided slots 130. The outer faces 129 of the slots are integral with wings 110 having downwardly outwardly directed legs 109, which run transverse to the web 111, and have formwork engaging feet 112 coplanar with the feet 113. Slots 130 terminate in bottom stops 131 which are integral with transverse tringular reinforcing plates 132 level with the under edge of web 111. These plates serve to strengthen the junction of the wings 110 to the web 111, retaining the plane of the wings and legs 109 at right angles to the web. The web includes a transverse stiffening rail 135 at its lower edge, the lower portions of tubular recesses 120 are stabilized by triangular ears 136 and 136' running parallel to web 111, between the underside of the web and terminating at the feet 113. Additional web extensions 137 are provided on web 111 at its upper edge between the upper ends of tubular recesses 120 and slots 130.

As can be seen in FIG. 5 the wire member 102 can be of any selected height (broken lines 102' represent an exemplified alternative situation for the top of a wire member) which merely requires the selection of a member 102 having legs of the correct length, (or of longer length which can be cut to correct length).

As further illustrated in FIG. 5, slots 130 can receive the T-girder vertical legs 140 of a tough plastic trestle or stand 141, which includes a transverse upper beam 142, again of a T-girder form, with centrally disposed lower reinforcing web 143. Raised on the upper surface of beam 142 and ribs 144. The wings 110 are relieved at 134 to accommodate the arm of the T of each leg 140.

Elongated bodies and cables of the type described earlier can be received in the spaces 145 between the ribs 144 and may be tied or wired into position as desired. Since the trestle 141 is made of a tough plastic like the base, it provides ample strength for support of the elongated bodies at a chosen position with respect to the formwofk edge, and is mounted on the same base structure that provides for high spacing of the concrete reinforcing rods with consequent saving of time and expense. The desired position of the elongated bodies can be achieved by merely cutting the legs 140 to correct length, or obtaining them pre-cut if more convenient, and inserting the legs into the slots 130 to bottom at 131. The broken lines show an exemplified second alternative location or beam 142. Since trestle 141 is of plastic, it may be moulded so that inch or centimeter markings are raised along the legs 140 (or both on alternate sides of the legs) showing distance from the edge of the formwork to the upper surface of beam 142. This enables cutting of the legs 140 without any need for measurement and enhances the possibility for speedy installation.

Several advantages flow from the structure illustrated. Weight transferred from the legs of wire member 102 is transmitted directly to the formwork by feet 113. Weight transferred from legs 140 to the base 101 is received both by the feet 113 through ears 136' and by the feet 112 from the legs 109. By virtue of the extension to the web 111 the wings 110 are, longitudinally of the web, well beyond the recesses 120. This affords extreme stability to the base 101 against any overturning or shifting forces applied to it when the reinforcing rod is being mounted in region 103 of wire member 102. This stability is enhanced by plates 132. The base is located in the position required by nailing to the formwork through lugs 116 as described for the structure of FIGS. 1 to 4.

I claim:

1. A high spacer chair for concrete reinforcing rods and for receipt in supporting formwork structure which comprises in combination;

a plastic base and a metal wire standoff spacer member insertably supported therein;

said metal wire member comprising a material capable of providing the predetermined strength necessary for receiving and supporting a reinforcing rod directly thereon and wherein said metal is subject to corrosion when exposed to the environment, said metal wire member being preformed to a predetermined size, having parallel oriented equilength downwardly depending legs for receipt and securing within the plastic base and an area defined on said member intermediate said legs for receipt of the reinforcing rod thereon, said base comprising a tough plastic and including a pair of parallel planar wings with a web transversely joining the wings, said wings comprising feet at outward downwardly directed ends thereof, at least one foot of each wing portion being positively securable on said formwork structure, a pair of substantially tubular vertically extending recesses integrally defined with said web, each recess being inwardly of a respective wing and defining a deep hole portion open at its upper end and terminating at its lower end adjacent to but spaced upwardly from a respective bottom foot, the said bottom feet and said wing feet being coplanar, each said recess securely receiving therein a respective leg of said wire member, with the lower end of each said leg abutting against the lower end of its respective hole, the lower end of each leg of said wire member thereby being spaced upwardly from the respective bottom foot, vertical thrusts in said legs of said metal wire member being transmittable directly against the lower end of the respective hole and thence directly to the respective bottom foot and thus to said formwork, a pair of vertically extending slots defined in said base at the junction of said wing and said web, a trestle member extending upwardly from the base including a pair of legs, and a transverse beam section, the legs of said trestle member being receivable in said slots for locating said beam section above said reinforcing rod receiving area on said wire member, said web ensuring mutually fixed spaced separation of the legs of the wire member, and said wire member being isolated from the effects of environmental corrosion when said spacer is present in a reinforced concrete structure, and overturning forces applied to said spacer being resisted by the outward separation of said wing feet from the legs of said wire member.

2. A spacer as defined in claim 1, said trestle legs being of T-section, the wings being relieved on the outward faces thereof for receipt of the respective arms of said T-section in said slots.

3. A spacer as defined in claim 2, comprising a respective reinforcing plate for each wing extending transversely outwardly of the web and integrally joined to said respective wing and said web.

4. A spacer as defined in claim 3, said beam section including a centrally disposed lower reinforcing web.

5. A spacer as defined in claim 3, said beam having transverse ribs raised on the upper side for receipt and location of elongated bodies therein.

6. A spacer as defined in claim 1, comprising tabs on at least one of said feet on each wing extending outwardly from its respective wing for positively attaching said feet to said supporting formwork structure.

7. A spacer as defined in claim 6, said tabs defining holes therethrough for the insertion of fastening members for attaching said base to said formwork structure.

8. A spacer as defined in claim 1, the lower portions of said wings and said web being relieved in the areas away from said respective feet.

9. A spacer as defined in claim 8, comprising reinforcing ears parallel with said web extending from said web adjacent to said bottom feet.

* * * * *